United States Patent [19]

Strobel et al.

[11] 4,256,540

[45] Mar. 17, 1981

[54] REGENERATIVE HEATING SYSTEM FOR HORIZONTAL COKE OVEN BATTERIES

[75] Inventors: Manfred Strobel; Friedrich Thiersch, both of Recklinghausen, Fed. Rep. of Germany

[73] Assignee: Firma Carl Still, Fed. Rep. of Germany

[21] Appl. No.: 967,612

[22] Filed: Dec. 8, 1978

Related U.S. Application Data

[63] Continuation of Ser. No. 853,817, Nov. 21, 1977, abandoned.

[30] Foreign Application Priority Data

Dec. 2, 1976 [DE] Fed. Rep. of Germany ..... 2654555

[51] Int. Cl.[3] ..... C10B 5/02; C10B 21/14

[52] U.S. Cl. ..... 202/139; 202/141; 202/151

[58] Field of Search ..... 202/141, 143, 144, 146, 202/151, 111, 139; 201/26, 41

[56] References Cited

U.S. PATENT DOCUMENTS

| | | | |
|---|---|---|---|
| 901,351 | 10/1908 | Koopers | 202/143 |
| 1,227,518 | 5/1917 | Crossen | 202/143 |
| 2,804,428 | 8/1957 | Van Ackeren | 202/151 |
| 3,344,039 | 9/1967 | Nestler | 202/144 |
| 4,008,129 | 2/1977 | Strobel | 202/222 X |
| 4,039,391 | 8/1977 | Gensler | 202/144 X |
| 4,085,008 | 4/1978 | Kinzler | 202/141 X |

*Primary Examiner*—Frank W. Lutter
*Assistant Examiner*—Roger F. Phillips
*Attorney, Agent, or Firm*—McGlew and Tuttle

[57] ABSTRACT

A horizontal coke oven battery construction in which a pusher is mounted to extend into the batteries from one side and push coke out of the batteries on the opposite side, comprises a plurality of coke oven batteries disposed in a row. A first waste gas flue extends along the pusher side of the batteries and a second waste gas flue extends along the coke side. A stack flue at one end of the batteries is connected to the first and second waste gas flues. The construction includes means for directing the heating gases into each oven battery during operation so that, in respect to the pusher and coke size, approximately one-half of the batteries is heated by upward burning and the other half is heated by downward burning. For example, all odd numbered batteries may be heated in the same direction and all even numbered batteries heated in the same direction. The invention also comprises a two-section regenerative heating system having reversing winches wherein the heating on one-half or approximately one-half of the oven chambers is equipped for upward burning and the heating of the other half is equipped with downward burning. Between the two halves, a center head may be provided, or only one reversing winch may be provided at the end of the battery.

2 Claims, 2 Drawing Figures

REGENERATIVE HEATING SYSTEM FOR HORIZONTAL COKE OVEN BATTERIES

This is a continuation of application Ser. No. 853,817 filed Nov. 21, 1977, and now abandoned.

FIELD AND BACKGROUND OF THE INVENTION

This invention relates in general to coke ovens and, in particular, to a new and useful two-section regenerative heating system of horizontal coke oven batteries.

DESCRIPTION OF THE PRIOR ART

It is usual to provide two-section regenerative heating systems of coke oven batteries arranged in a row with equipment such that all of the batteries burn at the same time at one side upwardly and at the opposite side, downwardly. Time-staggering during the heating periods of the individual batteries is provided only insofar as the switching is timed consecutively, in order to avoid great pressure variations in the lines supplying the fuel gas.

In such a design, the combustion gases of all of the batteries must be evacuated at the same side in order to be conducted to the stack. If, for reasons of space, only one stack is provided for a plurality of batteries at one end of the row of batteries, and the waste gas-collecting flues and other lines for the waste gases must be connected to the stack, flue cross-sections are obtained, particularly near the stack, which are so large that their accommodation within the range of the batteries becomes difficult.

SUMMARY OF THE INVENTION

The present invention is directed to the elimination of the difficulties of the prior art by an appropriate design of a two-section regenerative heating system of coke oven batteries, particularly, such batteries in which the waste gases are evacuated through a common stack.

In accordance with the invention, the heating system is equipped in a manner such that at the same time, i.e., the pusher side or the coke side, one-half or approximately one-half of the number of batteries is heated by upward burning and, the other half of the batteries is heated by downward burning. With an even number of batteries, the heating will advantageously be divided exactly in half and with an odd number, the heating will be approximately in half. Thus, in accordance with the invention, within the same heating period and at the same side, for example, the odd-numbered batteries I, III, V, etc., of a row of batteries may be heated by upward burning, and the even-numbered batteries II, IV, VI, etc., by downward burning. Consequently, within any heating period, only one-half of the waste gases of the battery are to be conducted to the stack from one side (the pusher side or the coke side) and substantially smaller cross-sections can be provided for the waste gas-collecting flues and the other waste gas conduits to the stack, so that their disposition within the range of the coke oven batteries becomes much simpler.

In the following, the inventive manner of heating will be termed crosswise battery heating. The crosswise battery heating, however, is not only applicable to a plurality of batteries arranged in a row, but also to a single battery.

The dimensions of up-to-date horizontal regenerative coke oven chambers are, for example, 7 m in height, 17 m in length, and 0.45 m in width. The carbonization period is about 13 hours and the fuel consumption and amount of waste gases and, thereby, the cross-sections of the conduits and flues, are of such magnitude that in single batteries having, for example, 50 oven chambers, an accommodation in the bench passageways or in the area of the oven block is difficult. In accordance with the invention, here again, the cross-sections of the conduits can be reduced.

A single horizontal coke oven battery, bisectional as to its heating system and heatable crosswise, so that, for example, on one side, one-half or substantially one-half in number of the oven chambers is heated by upward burning while the other hlaf is heated by downward burning is also as yet unknown. This also involves the particular problems of separating the two parts of the battery so as to prevent any leakage of heat, gas and air from one battery part to the other, and of dividing and designing the regenerators in the crossing area. The provision of a simple refractory wall in this area proved unsatisfactory.

Coke oven batteries are usually provided on their ends with battery heads comprising concrete walls to which the longitudinal anchor ties are also secured, and they further comprise thermally insulating brickwork. The thickness of such battery heads is considerable, for example, of about 2.0 m, and if an attempt is made to separate two parts of a battery by providing two heads therebetween, then, with the necessary passageway between the heads and their insulation, a building ground length of from 9 m to 10 m for oven chambers would be lost and, in most cases, this would be a prohibitive loss.

So-called center heads for coke oven batteries, comprising a double wall of steel concrete, which is parallel to the oven chambers an includes an intermediate space subdivided into cells by crosswalls are also known. Such center heads occupy a substantially smaller width than two complete battery heads, i.e., including the insulating walls, their width may be only about 5.50 m. However, experience has shown that, in the long run, center heads designed in this manner are not capable of standing the heat influence. With the passage of time, their mechanical resistance is reduced and they no longer perform their function of providing a bonding support for the individual ovens of the battery. This fact clearly manifests itself as old coke oven batteries are being demolished.

A battery center head of the above mentioned kind is known from German Pat. No. 2,359,667, in which each cell is provided in its lower portion with one or more fresh air inlets and at its top portion with corresponding air outlets.

A battery center head designed in accordance with the above-noted patent has proven to be resistant even in long run of operation, and this was due to the good air cooling of its walls. The additional width occupied by such a center head, inclusive of the insulating walls, is about 4 m, which is justifiable in view of the purpose.

It has further been found that a center head for coke oven batteries in accordance with the aforementioned German Pat. No. 2,359,667 is particularly suitable when it is provided between two battery parts which are heated crosswise, and that at this location, the head performs its function of preventing a heat transfer and a leakage of the heating media from one part of the battery to the other particularly well, and that at this location, it is also capable of withstanding the heat influence of the two parts of the battery in permanent operation.

The two adjacent regenerators are designed as half-regenerators in the crossing area, in a manner known per se, in order to ensure a supply of preheated heating media, lean gas and air, to the heating walls at both sides of the separating wall. Up to date, the regenerators at the end heads of the batteries have been designed in a similar manner.

It was not certain whether a modern coke oven battery with its large size oven chambers, divided in this manner, would have satisfactory stability. This has, however, been proven in practice. The inventive design is much simpler than the design with two complete battery heads and, as compared to the prior art design, considerable quantities of building material are saved.

In a coke oven battery of the prior art having 50 oven chambers of 7.00 m in height, 17.00 m in length, and 0.45 m in width and having a carbonization time of 13 hours for normal caking coal, the known design results in a cross-section of 3.75 $m^2$, i.e., inside width of 2.2 m, for the lean gas conduits to be placed in the bench passageways, and in a cross-section of 15 $m^2$, i.e., about 4 $\times$4 m, for the waste gas collecting flues. In accordance with the invention, the heating system of the coke oven battery in divided into two parts, each covering 25 coke oven chambers and, between these parts, a center head is provided, in accordance with German Pat. No. 2,359,667. In the inventive design, the cross-section required at either side is only 1.88 $m^2$ for the lean gas conduits, i.e., an inside width of about 1.55 m, and only 7.5 $m^2$ for the waste gas collecting flues, i.e., about 2.75$\times$2.75 m of inside clearance. The resulting overall length of the battery is 81.5 m. In the design with two prior art center heads, the battery would be longer by 5 m.

The two parts of the coke oven battery separated by the center head may each be equipped with a reversing winch for opening and closing the gas and air supply passages as well as the waste gas flues. However, it is advantageous to provide a single reversing winch for both halves of the battery, with the winch installed at one end of the battery and connected by means of a linkage in a manner such that, for example, in one-half of the battery, the cocks or valves are opened, while in the other half of the battery, the corresponding cock and valves are closed.

Accordingly, it is an object of the invention to provide a two-section regenerative heating system for horizontal coke oven batteries which includes a plurality of batteries disposed in a row and waste gas collecting flues connected to each other disposed on respective pusher and coke sides of the batteries, wherein, one-half or approximately one-half of the number of batteries is heated by upward burning and the other half is heated by downward burning.

Another object of the invention is to provide a two-section regenerative heating system of a horizontal coke oven battery having reversing winches, wherein, on the same side, the heating of one-half or approximately one-half of the number of oven chambers is equipped for upward burning and the heating of the other half is equipped for downward burning.

A further object of the invention is to provide a horizontal coke oven battery construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
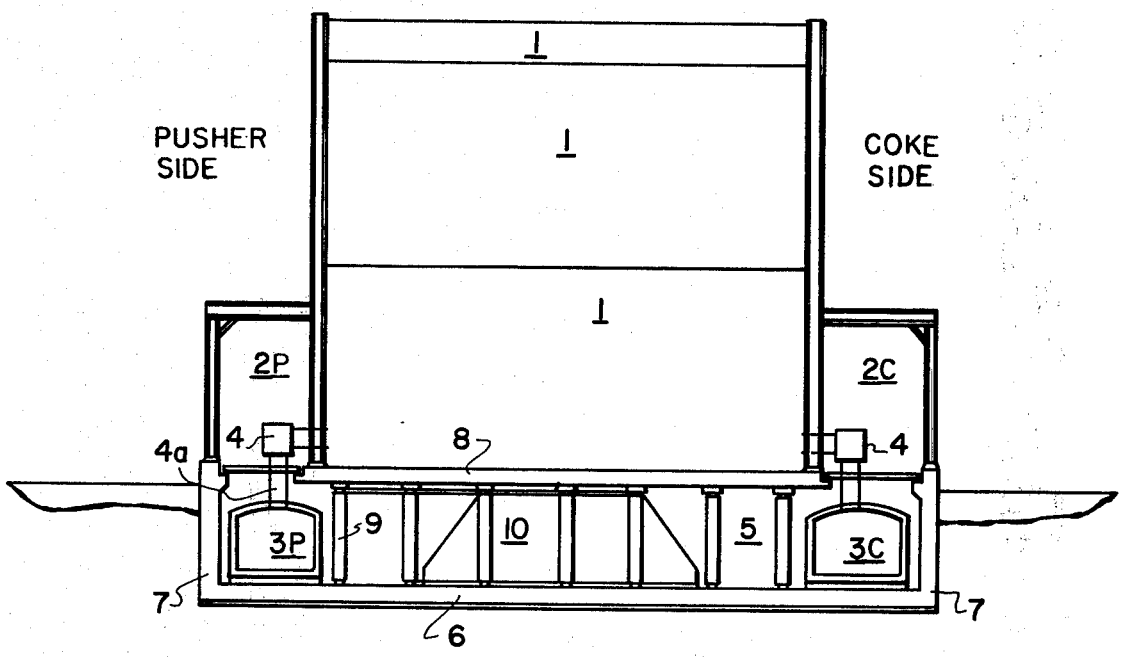
FIG. 1 is a schematic side elevational view of a coke oven battery constructed in accordance with the invention.

Referring to the drawings in particular, the invention embodied therein, comprises an underjet coke oven battery which is itself heated crosswise and which is constructed in accordance with the invention.

Figure 2:
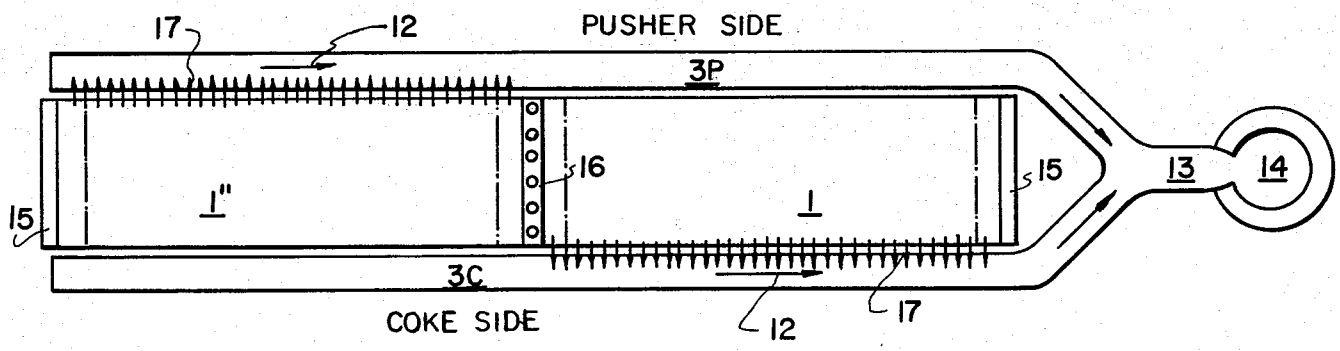
FIG. 2 is a top plan view of the coke oven battery shown in FIG. 1.

FIGS. 1 and 2 show the oven block 1 with regenerators, oven chambers, heating walls, and the roof of the battery, the bench passageways 2P and 2C, the waste heat flues 3P and 3c, waste heat valves 4 with connections *4a* to the waste heat flues, the so-called nozzle basement 5 with concrete supports 9 between the foundation plate 6 and the basement roof 8, corner supporting walls 7, fixed-point and swing walls 10, and the floor level 11 of the coke plant. Bench passage 2P and flue 3P are shown in a pusher side of oven block 1 with 2C and 3C on a coke side thereof.

FIG. 2 shows the waste gas flues 3P and 3C at the pusher and coke sides, the stack flue 13, the stack 14, the end heads 15 of the battery, and the center head 16 separating the two parts of the battery. The arrows 17 indicate that at the lefthand side 11 of center head 16, the pusher side burns downwardly, and at the righthand side 1 of the center head, the coke side burns downwardly, further that the waste heat gases pass through waste heat valves 4 and connections *4a* into the respective waste gas flues 3P and 3C (FIG. 1) and from there, in the direction of arrows 12, to stack flue 13 and stack 14.

The total cross-sectional area of flue 3P and 3C together are approximately equal to the cross-sectional area of the stack flue 13, and the cross-sectional area of flue 3P is approximately equal to that of flue 3C.

While a specific embodiment of the invention has been shown and described in detail in illustrate the application of the principles of the invention, it will be understood that the invention may be embodied otherwise without departing from such principles.

What is claimed is:

1. In a coke oven construction, comprising a coke oven battery having a pusher side on one side thereof and a coke side on the opposite side thereof, a first heating gas flue containing high temperature heating gas disposed along said pusher side, and a second heating gas flue containing high temperature heating gas disposed along said coke side, a stack flue adjacent one side of said coke oven battery connected to each of said first and second flues, and a connection means between said coke oven battery and said first and second heating gas flues for establishing a heating gas flue between said first and second flues and said coke oven battery; the improvement comprising, said coke oven battery divided into first (1) and second (1') longitudinally separated coke oven battery sections of substantially equal length, each having said pusher side on one side thereof and said coke side on the opposite side thereof, said connecting means (4,4a) establishing a heating gas flow from one of said first and second flues into one of said first and second sections in a downward direction on one of said pusher side and said coke side and a heating gas flow from the other of said first and second sections in an upward direction on the other of said pusher side and said coke side, a center head (16) disposed between said first and second coke oven battery sections, the cross-sectional area of said first heating gas flue (3P) being approximately equal to that of said second heating gas flue (3C) in the area adjacent said stack flue (13), the cross-sectional area of said stack flue (13) being approximately equal to the sum of the cross-sectional areas of said first and second heating gas flues.

2. In a horizontal coke oven battery construction in which a pusher is mounted to extend into the battery from one side and push coke out of the battery to the other side, comprising a plurality of coke ovens disposed in a row, a first waste gas flue extending along the pusher side of said battery, a second waste gas flue extending along the coke side of said battery, a stack flue at one end of said battery connected to said first and second waste gas flues; the improvement comprising means for directing heating gases into each oven during operation so that in respect to the pusher and coke sides, approximately one-half of the coke ovens are heated by upward gas flow and the other half are heated by downward gas flow, the cross-sectional area of said first and second waste gas flues being approximately equal in the area adjacent said stack flue, the cross-sectional area of said stack flue being equal to the sum of the cross-sectional areas of said first and second waste gas flues, said upward gas flue heated coke ovens disposed on one longitudinal side of said battery and said downward gas flow heated coke oven disposed on opposite longitudinal side of said battery, and a center head dividing said battery into said one and opposite sides for separating said upward and downward gas flows from each other.

* * * * *